US005575903A

United States Patent [19]

Kato

[11] Patent Number: 5,575,903

[45] Date of Patent: Nov. 19, 1996

[54] DRAIN WATER-INTAKE COVER

[75] Inventor: Setsuo Kato, Tokyo, Japan

[73] Assignee: Aluteck Co., Ltd., Tokyo, Japan

[21] Appl. No.: 403,953

[22] Filed: Mar. 14, 1995

[30] Foreign Application Priority Data

Jul. 22, 1994 [JP] Japan ..... 6-171024

[51] Int. Cl.[6] ..... E03F 5/14

[52] U.S. Cl. ..... 210/164; 210/170

[58] Field of Search ..... 52/169.5, 302.1; 4/292, 613, 654; 210/163, 164, 170, 747; 405/36, 52, 127

[56] References Cited

U.S. PATENT DOCUMENTS 1,858,268 5/1932 Fleming ..... 210/163 X 4,454,039 6/1984 McCoy ..... 210/164

FOREIGN PATENT DOCUMENTS 2269402 2/1994 United Kingdom ..... 52/302.1

*Primary Examiner*—Carl D. Friedman

*Assistant Examiner*—Timothy B. Kang

*Attorney, Agent, or Firm*—Oblon, Spivak, McClelland, Maier & Neustadt, P.C.

[57] ABSTRACT

A drain water-intake cover includes a fixed brim, a central convex portion of which is low in height, an upper water-intake opening on the convex portion, side water-intake openings on a side peripheral wall of the convex portion and a plurality of mutually spaced dust stoppers extending over the upper water-intake opening and having different height dimensions. Stumbling over the cover is prevented since the cover is low in height and is not highly protrusive. Rainwater can be drained even when dust or foreign matter such as fallen leaves, vinyl or trash clings to the cover. The cover dries easily even when rainwater remains on the cover.

2 Claims, 9 Drawing Sheets

DRAIN WATER-INTAKE COVER

FIELD OF THE INVENTION

BACKGROUND OF THE INVENTION

The present invention relates to a drain water-intake cover to be installed on a scupper and in particular relates to a drain water-intake cover which is low in height for prevention of stumbling over the cover, which can drain rainwater even when dust or foreign matter such as fallen leaves, vinyl or trash, clings to the cover and which readily dries for prevention of rusting even when rainwater remains on the cover.

DISCUSSION OF THE BACKGROUND

A drain is used for a scupper, for example on a rooftop or on a veranda on each floor of a building, an apartment or the like and serves to collect rainwater and discharge it downward. A water-intake cover is provided on the drain to prevent dust or solid matter from being introduced into the drain together with the rainwater and to avoid exposure of a large drain opening which otherwise may lead to danger or to poor outlook.

FIG. 1 shows a conventional scupper wherein a drain 1 is fitted into a drain pipe 4 in a drain through-opening 3 on a floor 2 of for example a veranda and fixed to the floor 2. A drain water-intake cover 5 is fixed to a top of the drain 1.

The drain 1 has a peripheral wall 6 defining a drain passage which is inversely frustoconical and convergent downward. The wall 6 is formed at its larger-diameter upper end with a fixed flange 7 which is inclined upwardly and radially outwardly and is in the pipe 4 at its smaller-diameter lower end. The flange 7 is fitted in a shallow groove 8 on the floor 2 surrounding the through-opening 3 and is fixed to the floor 2 by a method known per se such as bolting.

The flange 7 is sheeted by a waterproof sheet 9 which extends to the floor 2. The cover 5 is fixed to the flange 7 by bolts 10 with the sheet 9 being squeezed between the cover 5 and the flange 7. In the figures, reference numeral 11 represents a packing sheet and 12 indicates a joint filler.

As shown in FIGS. 2 to 4, the cover 5 is in the form of a hat and comprises a fixed brim 13 and a central, semispherical convex portion 14. The brim 13 has a lower surface **13*a* inclined upwardly and radially outwardly for stabilization of the cover 5 on the drain 1 and has an upper surface 13*b* inclined downwardly and radially outwardly for promoted discharge of rainwater on the brim 13 to outside. The convex portion 14 is formed with a number of water-intake holes or openings 15**.

The convex portion 14 has recesses 17 for fixing purpose at its predetermined peripheral points (three points in FIG. 2). Each of the recesses 17 is recessed radially inwardly to have a bottom surface 16 aligned with the upper surface **13*b* of the brim 13**, which is inclined downwardly and radially outwardly.

The bottom surface 16 is formed with a vertical bolt hole 18 through which the bolt 10 is screwed into a corresponding bolt hole 19 on the drain 1 as shown in FIGS. 1 and 4, thereby fixing the cover 5 to the drain 1. In the figures, reference numeral 20 denotes a locking washer. Provision of the recess 17 for the bolt 10 will protect the bolt 10 against any possible colliding material or matter and provide better outlook.

The conventional drain water-intake cover 5 as described above has various problems. People may stumble over the cover 5 installed for example on a veranda where people walk since the cover 5 is highly protrusive due to its semispherical convex portion 14. When dust or foreign matter 21, such as fallen leaves, vinyl or trash, clings to and covers the simply curved convex portion 14 as shown in FIG. 3, the water-intake holes 15 of the portion 14 are blocked to hinder drainage of rainwater. Moist dust or scrap clinging to the simply curved surface as described above is not easily detached and is difficult to dry, so that rusting is most likely to occur on the cover 5 or on the bolts 10, which fact leads to poor external appearance and low durability.

Moreover, since the vertical bolt hole 18 is provided and the bottom surface 16 of the recess 17 is inclined as shown in FIG. 4, there is a gap between a head **10*a* of the bolt 10 and the washer 20 or between the washer 20 and the bottom surface 16 of the recess 17, which hinders sufficient tightening of the bolt 10. Further, rainwater tends to remain between the washer 20 and the bottom surface 16 of the recess 17 and between the washer 20 and the bolt head 10*a* and drying at these portions is hindered. This causes rusting on the bolt 10** and leads to poor external appearance and low durability.

SUMMARY OF THE INVENTION

A drain water-intake cover according to the present invention was made to overcome the above-mentioned problems encountered in the prior art and comprises a fixed brim, a central convex portion which is low in height, an upper water-intake opening on said convex portion, side water-intake openings on a side peripheral wall of the convex portion and a plurality of mutually spaced dust stoppers extending over the upper water-intake opening and having different height dimensions. According to the present invention, stumbling over the cover is prevented since the cover is low in height and is not protrusive. Water can be drained even when dust or foreign matter such as fallen leaf or vinyl or the like scrap clings to the cover. Moreover, rusting on the cover is prevented since the cover easily dries even when rainwater tends to remain on the cover.

The present invention will become more apparent from the following description of a preferred embodiment thereof taken in conjunction with the attached drawings.

DESCRIPTION OF THE PREFERRED EMBODIMENT

Figure 1:
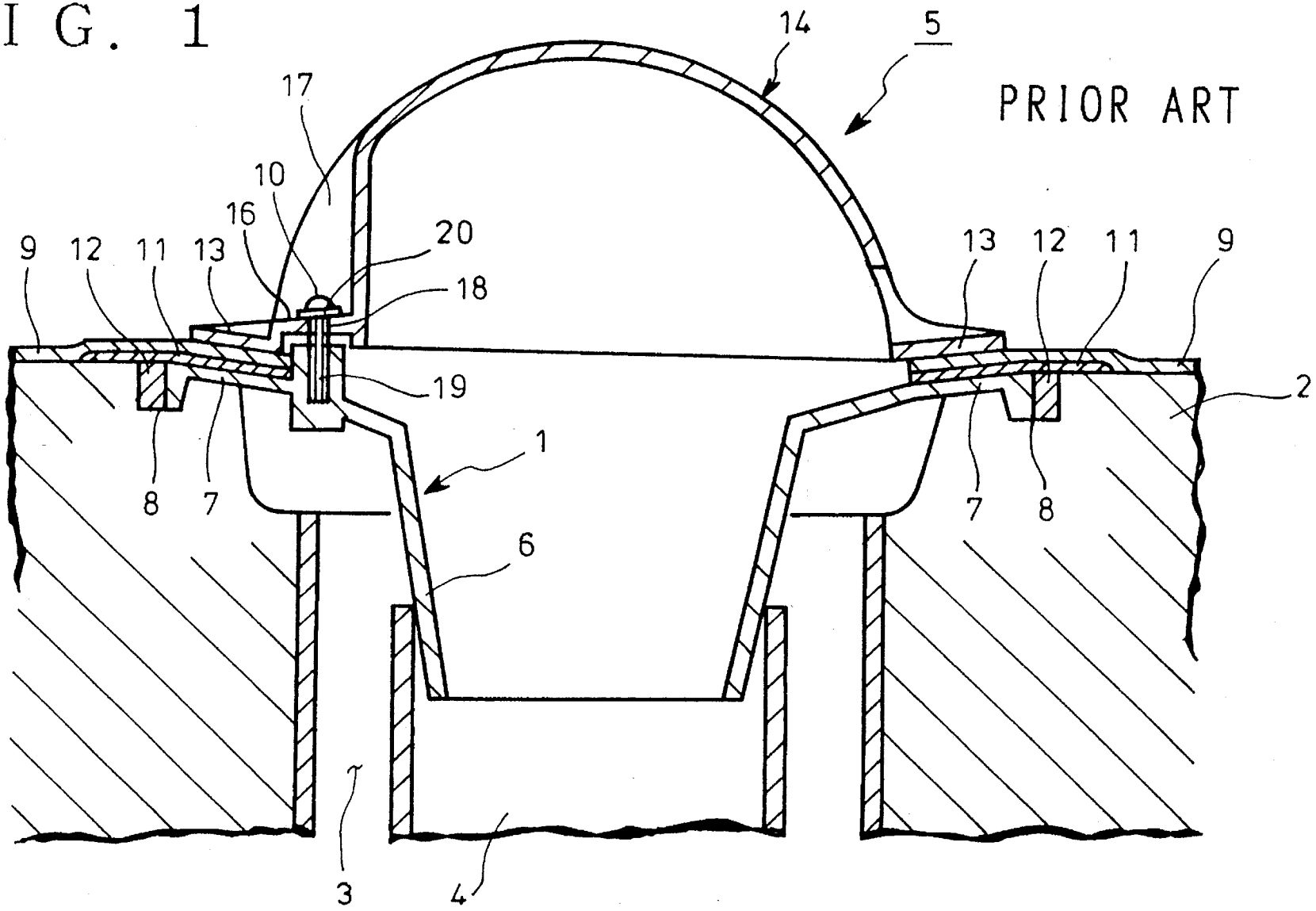
FIG. 1 is a vertical sectional view of a conventional scupper.
Figure 2:
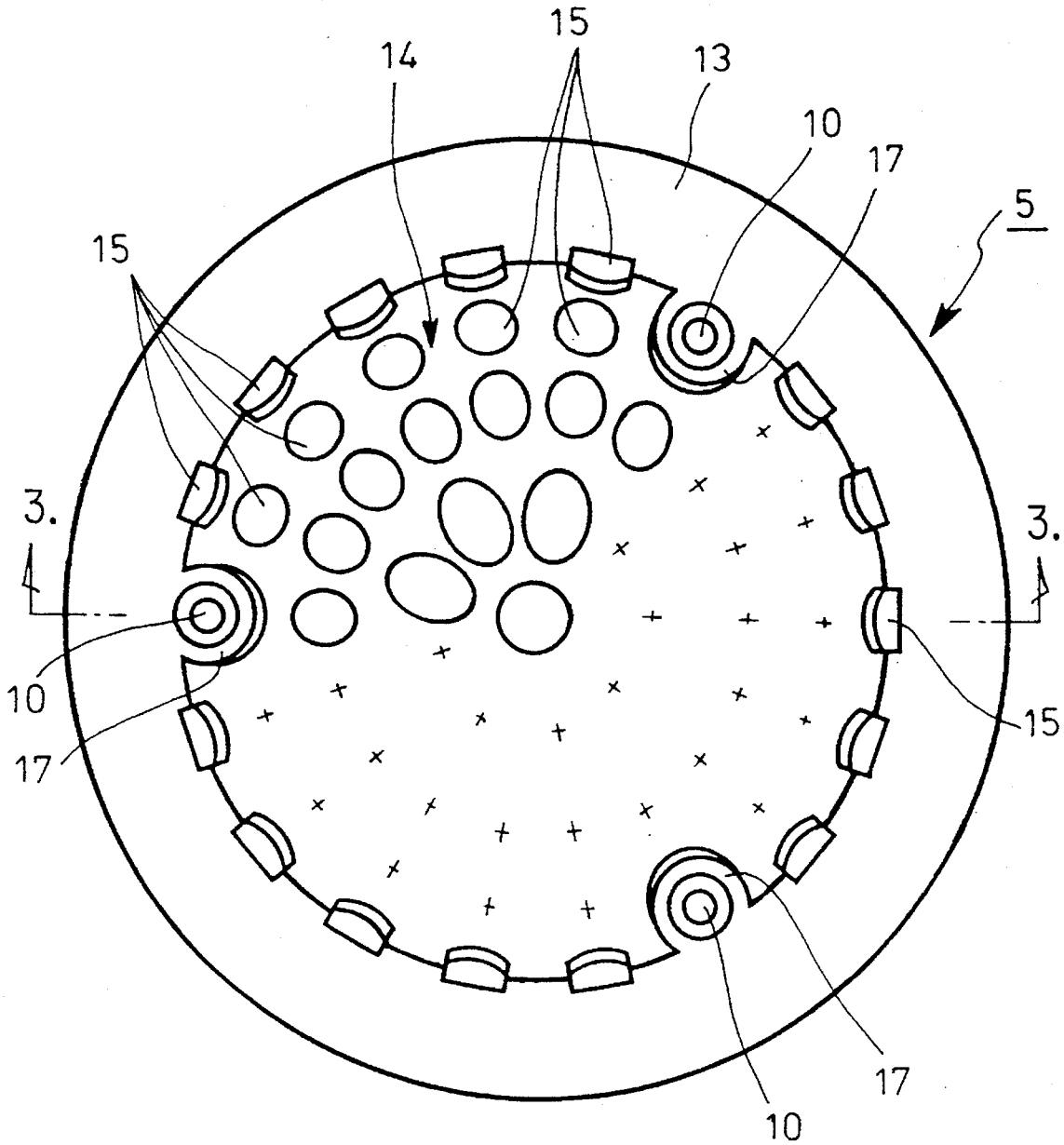
FIG. 2 PRIOR ART
FIG. 2 is a plan view of a conventional drain water-intake cover.
Figure 3:
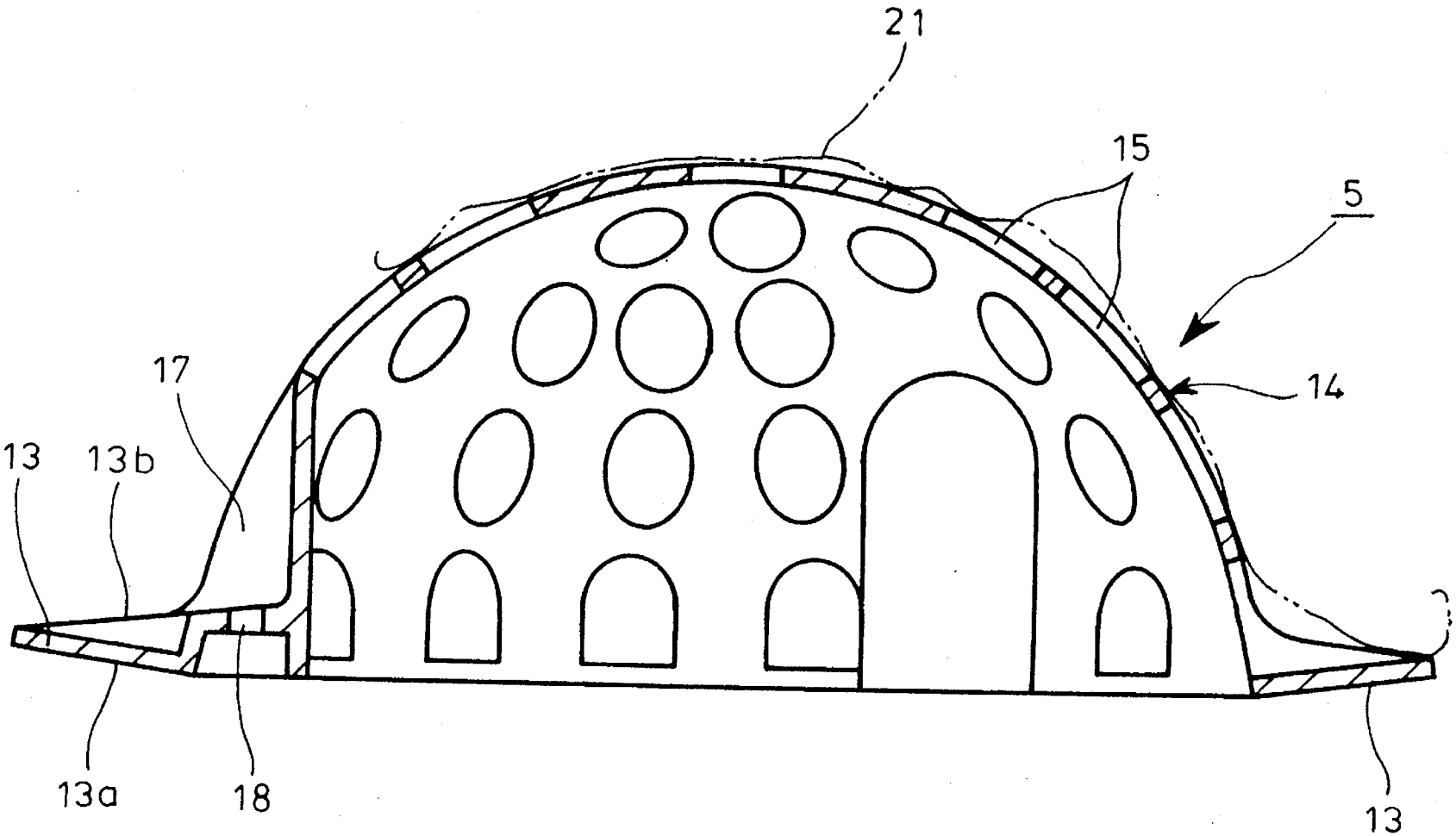
FIG. 3 PRIOR ART
FIG. 3 is a vertical sectional view along the line 3—3 of FIG. 2.
Figure 4:
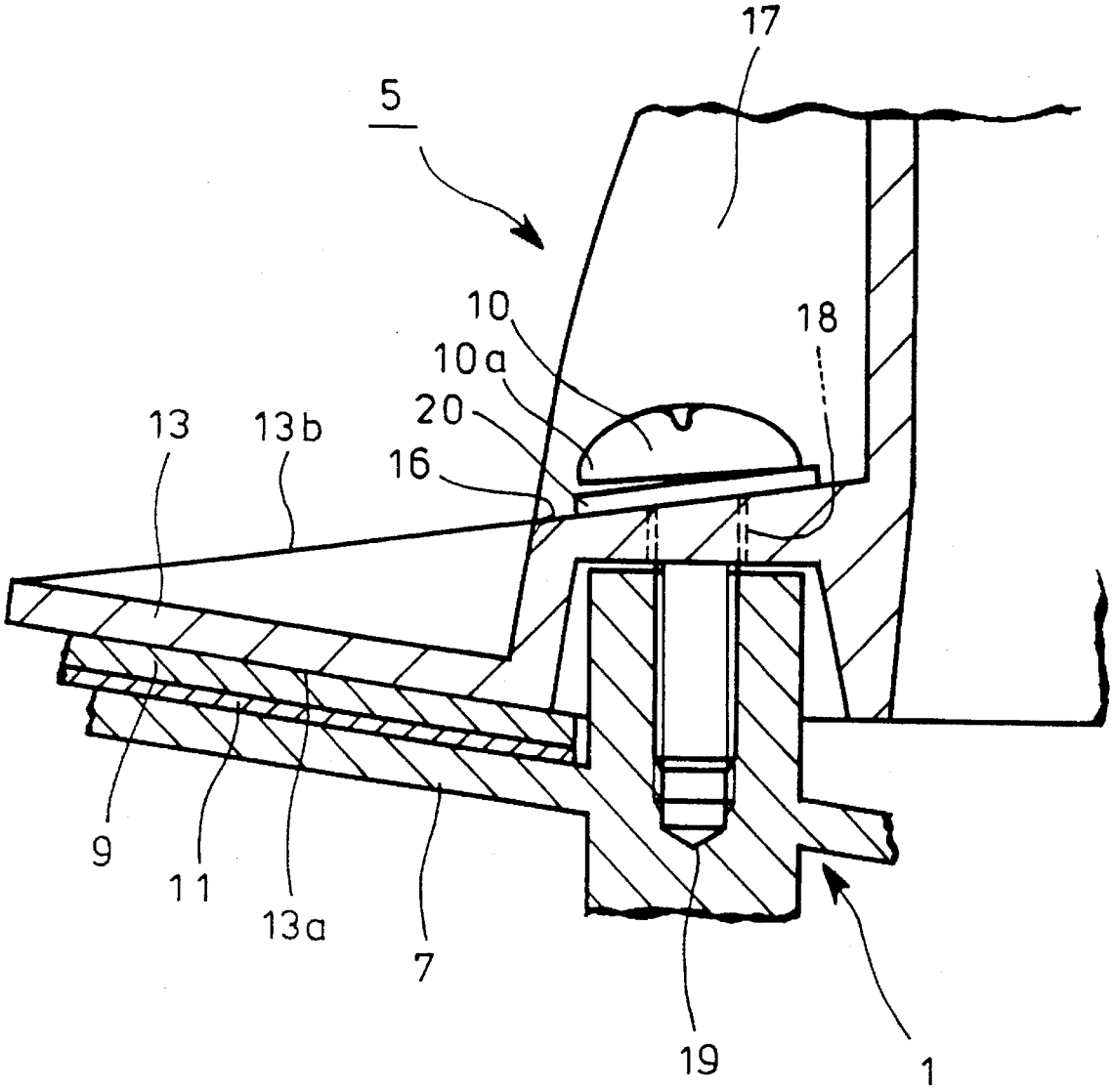
FIG. 4 PRIOR ART
FIG. 4 is an enlarged vertical sectional view of the belt hole and its surroundings shown in FIG. 3.
Figure 5:
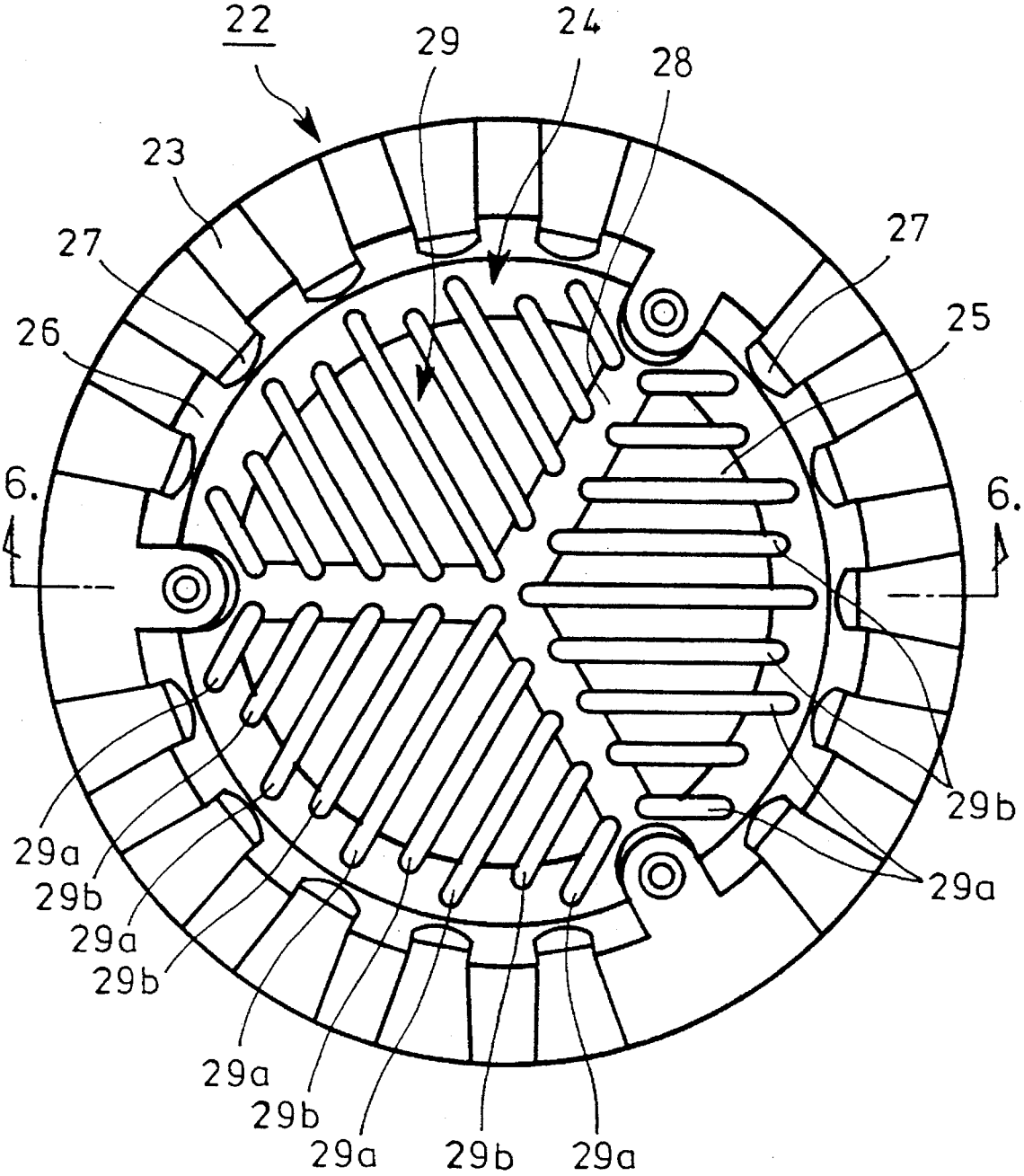
FIG. 5 is a plan view of a drain water-intake cover of the present invention.

FIGS. 5 to 9 show a preferred embodiment of a drain water-intake cover 22 according to the present invention. In these figures, the same components as those shown in FIGS. 1 to 4 are referred to by the same reference numerals and detailed description thereon is omitted.

The water-intake cover 22 comprises a fixed brim 23 and a central convex portion 24. The brim 23 has a lower surface 23*a* inclined upwardly and radially outwardly for stabilization on the drain 1 as shown in FIG. 1 and an upper surface 23*b* inclined downwardly and radially outwardly for promoted discharge of rainwater on the brim 23 to the outside. The convex portion 24 is short in height, is of substantially trapezoidal vertical section and is centrally formed with a large upper water-intake opening 25.

The convex portion 24 has also a side peripheral wall 26 having a plurality of side water-intake openings 27 spaced apart from each other.

Support arms 28 bridges over the opening 25 and radially extend to 3 points on the convex portion 24, the arms 28 being angularly spaced apart from each other by substantially 120 degrees, thus dividing the opening 25 into three opening sectors. A set of mutually spaced rod-like dust stoppers 29 extend over each of the opening sectors respectively defined by two of the arms 28. The dust stoppers 29 for each opening sector defined by the two arms 28 as shown in the figures are arranged in parallel with each other and in parallel with the remaining arm 28. The dust stoppers 29 have different height dimensions and, in FIG. 6, high and low dust stoppers 29*a* and 29*b* are alternately arranged.

Figure 6:
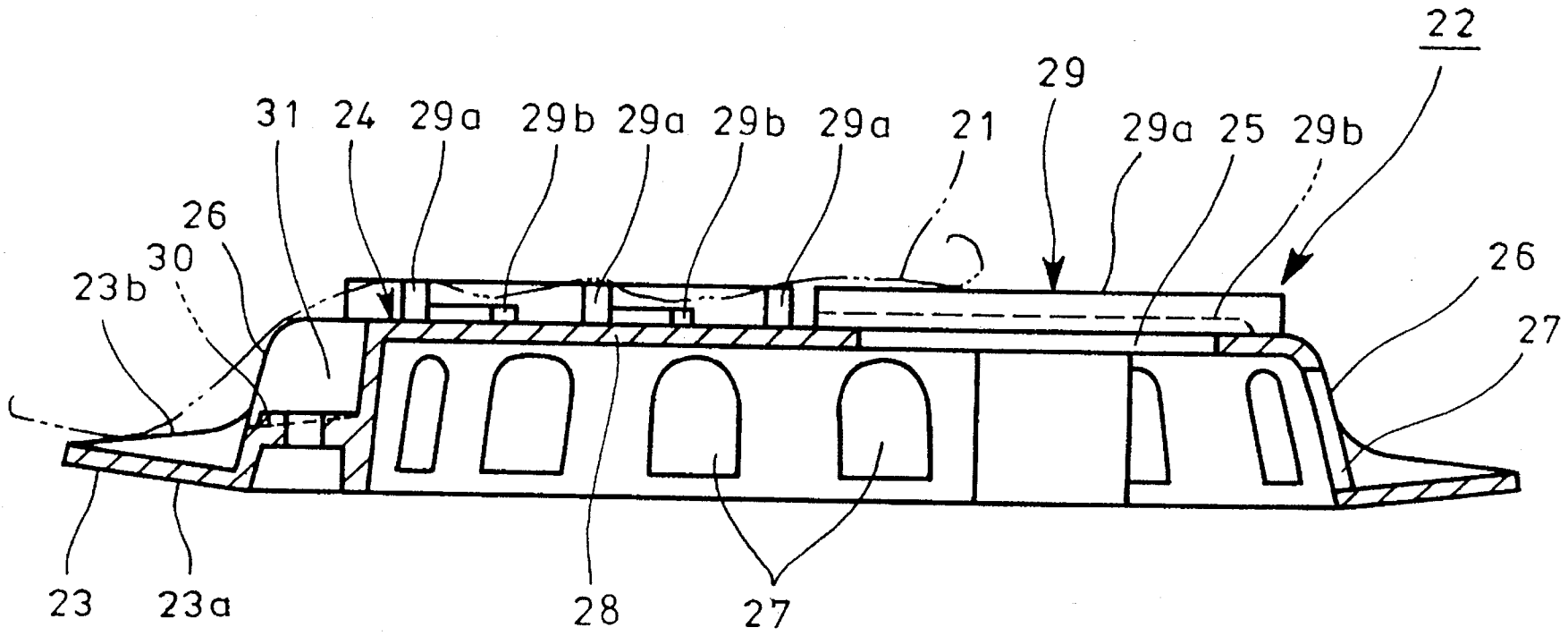
FIG. 6 is a vertical sectional view along the line 6—6 of FIG. 5.
Figure 7:
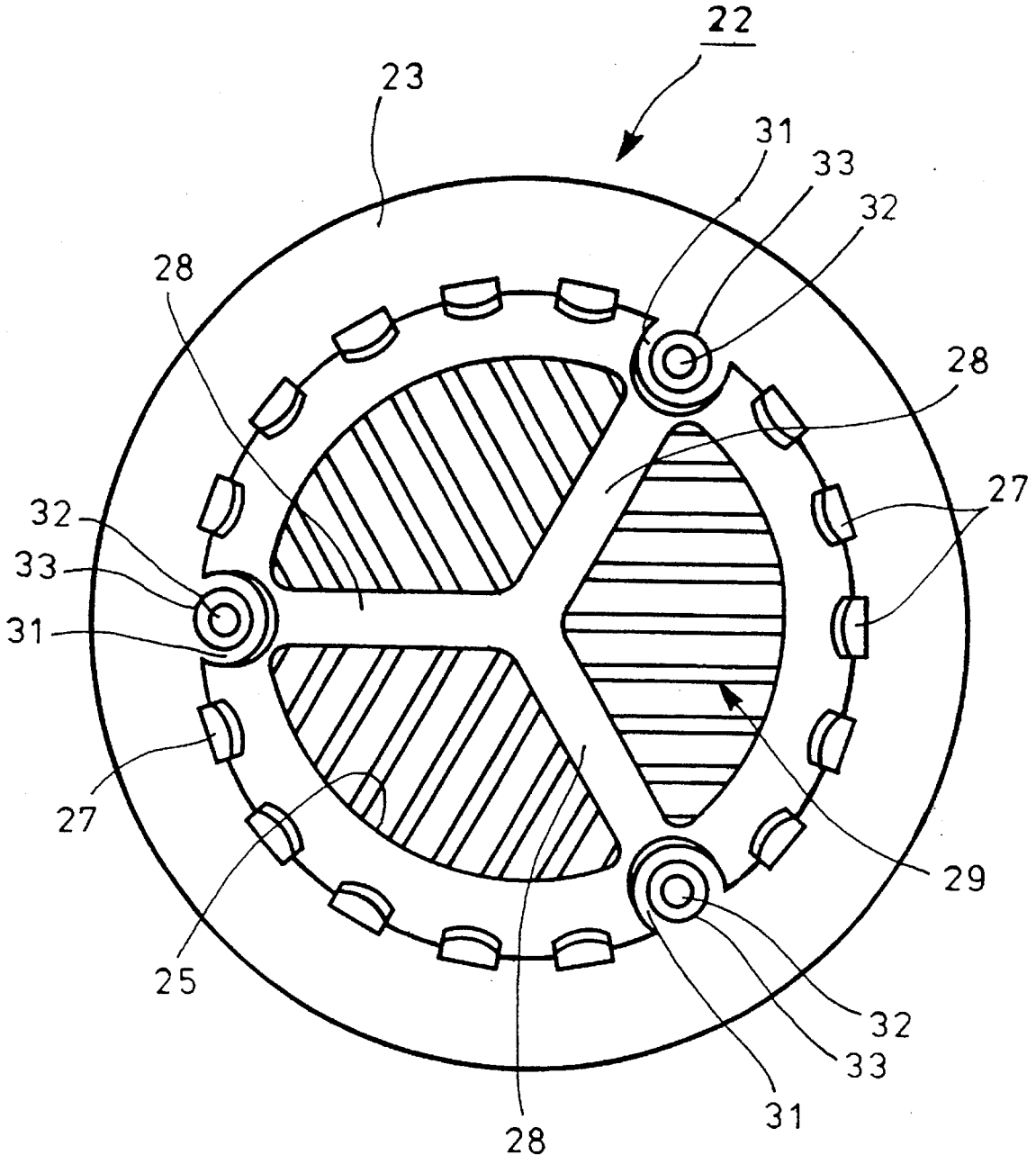
FIG. 7 is a bottom view of the drain water-intake cover of FIG. 5.
Figure 8:
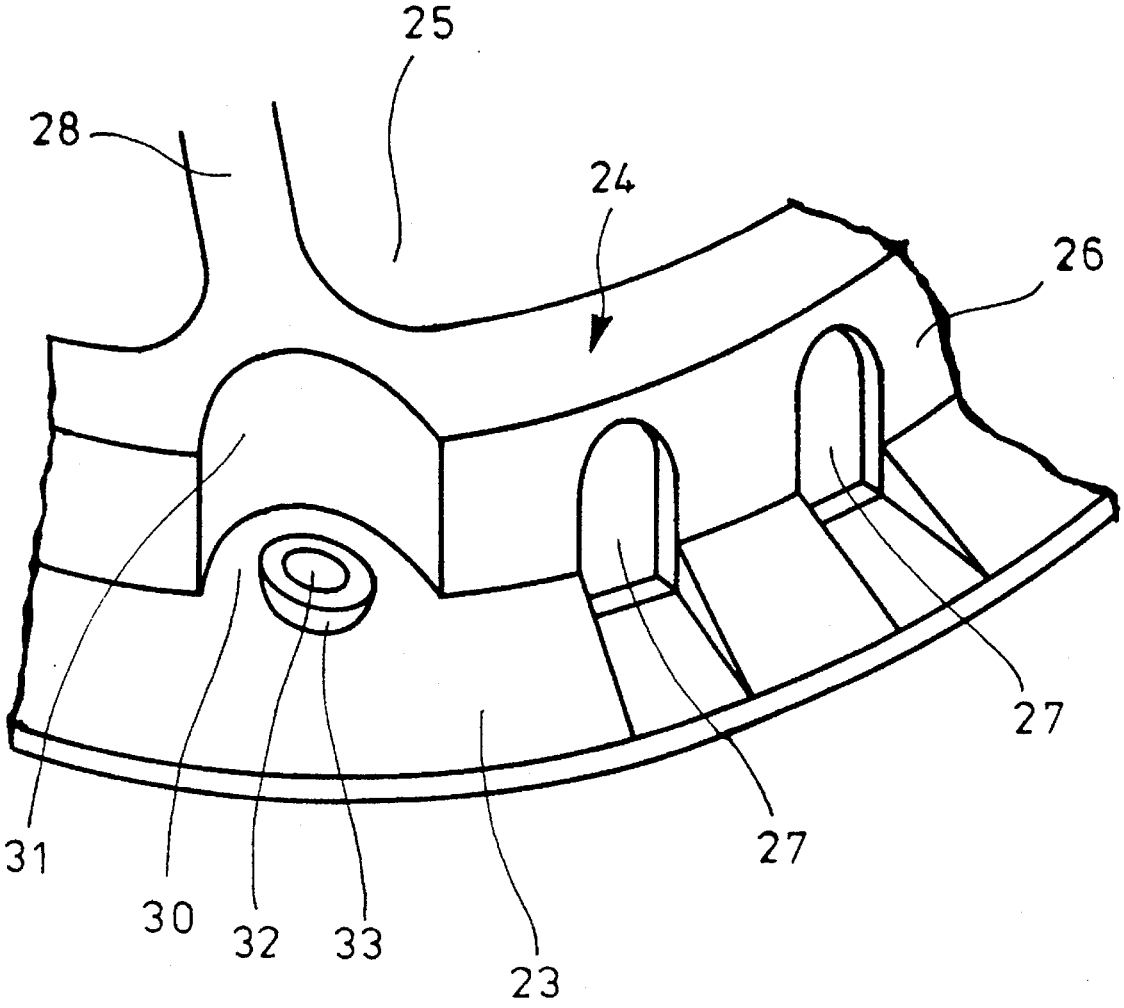
FIG. 8 is an enlarged perspective view of the bolt hole and its surroundings shown in FIG. 5.
Figure 9:
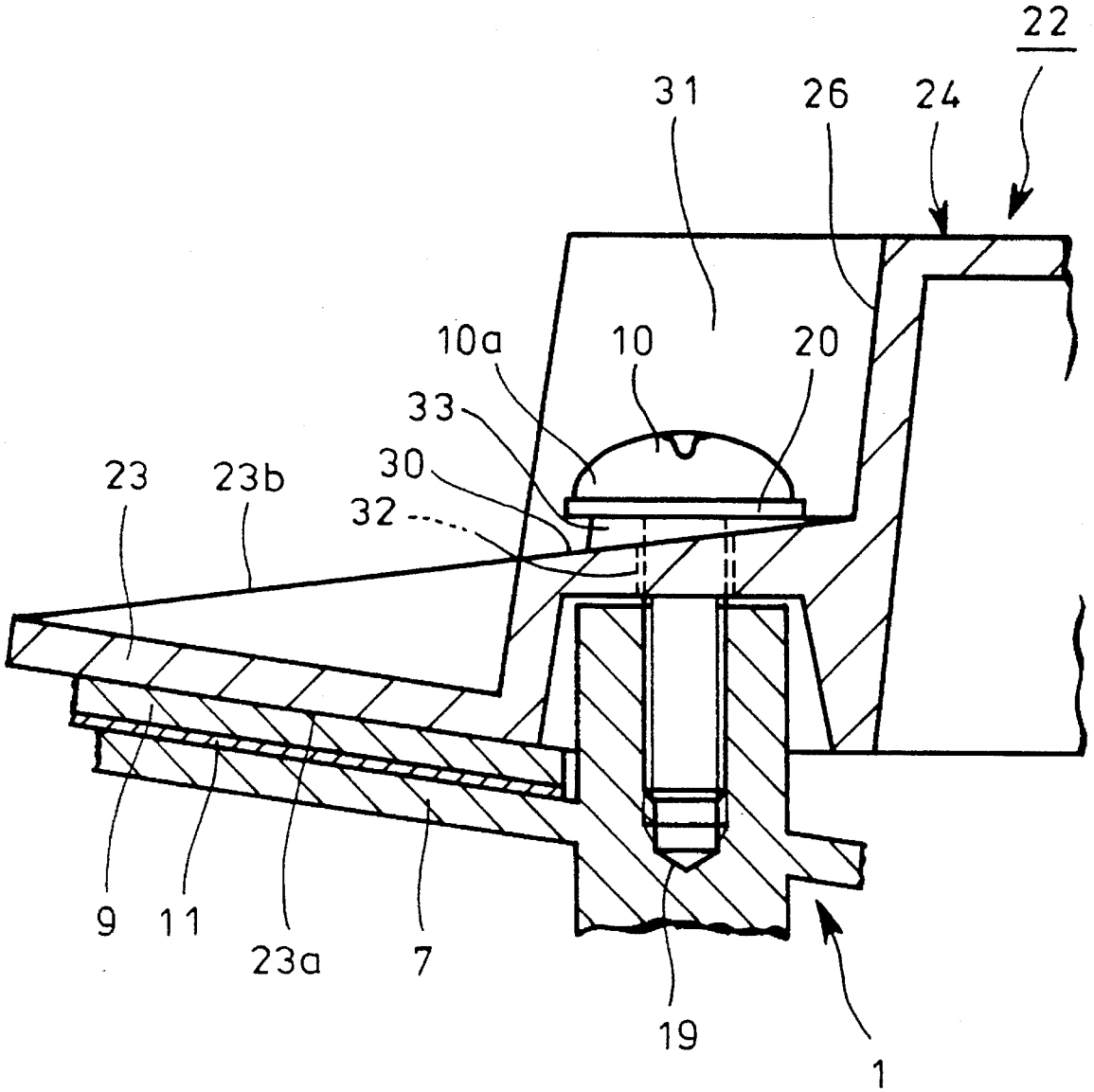
FIG. 9 is a vertical sectional view of the portion shown in FIG. 8.

Recesses 31 are provided at predetermined points (three points in FIG. 5) on the side peripheral wall 26. Each of the recesses 31 is recessed radially inwardly to have a bottom surface 30 inclined downwardly and radially outwardly as shown in FIGS. 6 and 9 and aligned with the upper surface 23*b* of the brim 23. A vertical bolt hole 32 is provided on the bottom surface 30 of the recess 31. Further, a bolt bearer 33 is protruded on the bottom surface 30 to surround the bolt hole 33. The bolt bearer 32 has a horizontal top surface and is of smaller diameter than that of the bolt head 10*a*.

Next, description will be given on how the above-mentioned embodiment works.

According to the drain water-intake cover 22 as shown in FIGS. 5 to 9. the convex portion 24 is low in height and has the upper and side water-intake openings 25 and 27. Since the water-intake cover 22 is therefore not highly protrusive, stumbling over the cover upon walking is prevented. Since the dust stoppers 29*a* and 29*b* having different height dimensions are alternately arranged over the upper water-intake opening 25, even when dust 21 or foreign matter such as fallen leaves, vinyl or trash clings to the cover, water can be drained laterally because of space created by difference in height between the dust stoppers 29*a* and 29*b* as shown in FIG. 6. Since ventilation is improved due to such space created by the difference in height between the stoppers, the water-intake cover 22 dries much easier, which prevents rusting on the cover.

As shown in FIG. 9, the bolt bearer 33 on the inclined bottom surface 30 of the recess 31 has the upper horizontal surface and is of smaller diameter than that of the bolt head 10*a*. This makes it possible to sufficiently tighten the bolt 10 without tilting of the same and rainwater does not remain between the bolt head 10*a* and the washer 20 and between the washer 20 and the bottom surface 30. Since water is completely drained, the cover easily dries and rusting can be prevented.

It is to be understood that the present invention is not limited to the embodiment described above and that various modifications may be made without departing from the true spirit and scope of the invention. For example, the invention is applicable to a scupper on a rooftop of a building. The convex portion may be of various vertical section such as rectangular vertical section. The dust stoppers may be of any height dimensions and dust stoppers with three or more different height dimensions may be used. The dust stoppers may be arranged in various patterns such as radial and partly radial patterns.

As described above. in a drain water-intake cover according to the present invention, a convex portion low in height is provided which has upper and side water-intake openings, so that the danger of stumbling over the cover can be prevented. Because of the plurality of mutually spaced dust stoppers extending over the upper water-intake opening and having different height dimensions, even when dust or foreign matter, such as fallen leaves, vinyl or trash clings to the cover, water can be drained through the space created by the in height between the dust stoppers and the cover easily dries due to the space created by such difference in height between the dust stoppers. Thus, it is possible to prevent rusting. to provide better external appearance and to improve durability.

In a drain water-intake cover according to the present invention, a bolt bearer is protruded on the inclined bottom surface of the recess to surround the bolt hole, the bolt bearer having a horizontal top surface and being of smaller diameter than that of the bolt head. As a result, sufficient tightening of the bolt is ensured and rainwater does not remain between the washer and the bolt head and between the washer and the bottom surface of the recess. Water is completely drained and the cover dries much easier. Thus, it is possible to prevent rusting, to provide a better appearance and to ensure a longer service life of the cover.

What is claimed is:

1. A drain water-intake cover, which comprises:

a fixed brim;

a central convex portion which is low in height wherein an upper water-intake opening is formed in said convex portion and side-wall intake openings are located on a side peripheral wall of the convex portion;

three support arms radially extending and bridging said upper water-intake opening, said arms having an angularly displaced relationship from each other of substantially 120degrees; and a plurality of mutually spaced rod-shaped dust stoppers extending centripetally over said upper water-intake opening, said dust stoppers being uneven in height.

2. A cover according to claim 1, wherein a plurality of recesses are formed on the peripheral wall of the convex portion, each of said recesses being recessed radially inwardly to form a bottom surface inclined downwardly and radially outwardly and which are aligned with an upper surface of the brim, a bolt hole is formed on the bottom surface of each of the recesses, and wherein a bolt bearer is protruded from the bottom surface of each of the recesses to surround said bolt hole, said bolt bearer being of a smaller diameter than a head of a bolt to be screwed into the bolt hole.

* * * * *